US012662952B2

(12) United States Patent
Lin et al.

(10) Patent No.: US 12,662,952 B2
(45) Date of Patent: Jun. 23, 2026

(54) OIL PRESSURE CONTROL SYSTEM AND CONTROL METHOD THEREOF

(71) Applicant: INDUSTRIAL TECHNOLOGY RESEARCH INSTITUTE, Hsinchu (TW)

(72) Inventors: Szu-Chia Lin, Yilan City (TW); Cheng-Kai Huang, Taichung City (TW); Shi-Jie Luo, Yuanlin City (TW); Shih-Jie Wei, Taichung City (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 407 days.

(21) Appl. No.: 18/396,242

(22) Filed: Dec. 26, 2023

(65) Prior Publication Data

US 2025/0207518 A1 Jun. 26, 2025

(51) Int. Cl.
*F01M 1/16* (2006.01)
*F01M 1/20* (2006.01)
(Continued)

(52) U.S. Cl.
CPC ..... *F01M 1/16* (2013.01); *F01M 1/20* (2013.01); *F04B 17/03* (2013.01); *F04B 49/065* (2013.01);
(Continued)

(58) Field of Classification Search
CPC .. F01M 1/16; F01M 2250/60; F01M 2250/64; F04B 17/03; F04B 49/065;
(Continued)

(56) References Cited

U.S. PATENT DOCUMENTS

2002/0069847 A1 6/2002 Iwano et al.

FOREIGN PATENT DOCUMENTS

CN 101900153 B 7/2012
CN 202381417 U 8/2012
(Continued)

OTHER PUBLICATIONS

TW Office Action dated Nov. 5, 2024 in application 112150677.
(Continued)

*Primary Examiner* — Marina A Tietjen
(74) *Attorney, Agent, or Firm* — Maschoff Brennan

(57) ABSTRACT

An oil pressure control method, adapted for mechanical equipment, includes: providing a control device, obtaining a processing program including a processing start code and a motor activation code of a motor, calculating an interval period between the two codes, setting the interval period as a default blank period in a motor operation timing sequence when the interval period is not shorter than a default period and setting a wake-up interval in the default blank period, setting the interval period as a low speed period in the motor operation timing sequence when the interval period is shorter than the default period, and controlling the motor according to the motor operation timing sequence, wherein an interval in the default blank period except the wake-up interval indicates the motor has a first rotational speed, the low speed period indicates the motor has a second rotational speed higher than the first rotational speed.

16 Claims, 8 Drawing Sheets

(51) Int. Cl.

| | |
|---|---|
| ***F04B 17/03*** | (2006.01) |
| ***F04B 49/06*** | (2006.01) |
| *F04B 23/02* | (2006.01) |
| *F04B 49/10* | (2006.01) |

(52) U.S. Cl.
CPC ..... *F01M 2250/60* (2013.01); *F01M 2250/64* (2013.01); *F04B 23/02* (2013.01); *F04B 49/10* (2013.01)

(58) Field of Classification Search
CPC ..... F04B 23/02; F04B 49/10; F04B 49/08; F04B 49/20; F15B 1/02; F15B 1/033; F15B 13/042; F15B 11/08; F15B 11/028; F15B 15/14; F15B 19/00; F15B 21/02; F15B 21/041; F15B 2201/411; F15B 2201/51; F15B 2211/212; B23Q 3/12; B23Q 2703/04
See application file for complete search history.

(56) References Cited

FOREIGN PATENT DOCUMENTS

| | | | | | |
|---|---|---|---|---|---|
| CN | 102003421 | B | | 2/2013 | |
| CN | 103321974 | A | | 9/2013 | |
| CN | 105545833 | A | | 5/2016 | |
| CN | 106499614 | B | | 11/2017 | |
| CN | 112628223 | A | * | 4/2021 | ..... F15B 20/00 |
| CN | 113184732 | A | | 7/2021 | |
| CN | 115681218 | A | | 2/2023 | |
| CN | 116181714 | | * | 5/2023 | |
| CN | 116181714 | A | | 5/2023 | |
| TW | 202022242 | | * | 6/2020 | |
| TW | 202022242 | A | | 6/2020 | |
| WO | WO-2022267483 | A1 | * | 12/2022 | ..... H02P 7/2913 |

OTHER PUBLICATIONS

Sugimura, K. et al., "Using Intermittently Operated Oil Hydraulic Pump Unit with Accumulator to Save Energy," Int. J. of Automation Technology, vol. 6, Issue 4, pp. 426-433 (2012).

Xu, X. et al., "Speed control of Hydraulic elevator by using PID controller and self-tuning fuzzy PID controller," 32nd Youth Academic Annual Conference of Chinese Association of Automation (YAC), pp. 812-817 (2017).

Ramesh, S. et al., "Energy Efficient Hydraulic Clamping System using Variable Frequency Drive in a CNC Machine," IOP Conference Series: Materials Science and Engineering, vol. 376, 012124, (2018).

Bao, Z. et al., "Optimization of Variable Frequency Hydraulic System of Filling Machine Based on Fuzzy Adaptive Control," IOP Conference Series: Earth and Environmental Science, vol. 252, 032076 (2019).

Yin, S. et al., "Location of abnormal energy consumption and optimization of energy efficiency of hydraulic press considering uncertainty," Journal of Cleaner Production, vol. 294, 126213, (2021).

* cited by examiner

OIL PRESSURE CONTROL SYSTEM AND CONTROL METHOD THEREOF

BACKGROUND

1. Technical Field

The present disclosure relates to an oil pressure control system and control method thereof.

2. Related Art

Oil pressure control systems are often used in power output units of mechanical equipment (such as machine tools) to provide power sources such as hydraulic turret and hydraulic chucks. The existing oil pressure control system will continuously operate and output at full power after being activated.

SUMMARY

According to an embodiment of the present disclosure, an oil pressure control method, adapted for mechanical equipment, includes: providing a control device; obtaining, by the control device, a processing program from the mechanical equipment, wherein the processing program comprises a processing start code and a motor activation code of a motor; calculating, by the control device, an interval period between the processing start code and the motor activation code; determining, by the control device, whether the interval period is not shorter than a default period; setting, by the control device, the interval period as a default blank period in a motor operation timing sequence and setting, by the control device, a wake up interval in the default blank period according to the motor activation code when determining the interval period is not shorter than the default period; setting, by the control device, the interval period as a default low speed period in the motor operation timing sequence when determining the interval period is shorter than the default period; and controlling, by the control device, the motor according to the motor operation timing sequence; wherein an interval except for the wake up interval in the default blank period indicates the motor having a first rotational speed, and the default low speed period indicates the motor having a second rotational speed, wherein the first rotational speed is lower than the second rotational speed.

According to an embodiment of the present disclosure, an oil pressure control system, adapted for mechanical equipment, includes: a motor and a control device. The control device is connected to the mechanical equipment, and configured to perform: obtaining a processing program from the mechanical equipment, wherein the processing program comprises a processing start code and a motor activation code of a motor; calculating an interval period between the processing start code and the motor activation code; setting the interval period as a default blank period in a motor operation timing sequence and setting a wake up interval in the default blank period according to the motor activation code when determining the interval period is not shorter than a default period; setting the interval period as a default low speed period in the motor operation timing sequence when determining the interval period is shorter than the default period; and controlling the motor according to the motor operation timing sequence; wherein an interval except for the wake up interval in the default blank period indicates the motor having a first rotational speed, and the default low speed period indicates the motor having a second rotational speed, wherein the first rotational speed is lower than the second rotational speed.

DETAILED DESCRIPTION

The detailed features and advantages of the present invention are described in detail below in the embodiments. Numerous specific details are set forth in order to provide a thorough understanding of the disclosed embodiments. According to the description, claims and the drawings disclosed in the specification, one skilled in the art may easily understand the concepts and features of the present invention. The following examples further illustrate the aspects of the present invention in detail, but are not meant to limit the scope of the present invention.

Figure 1:
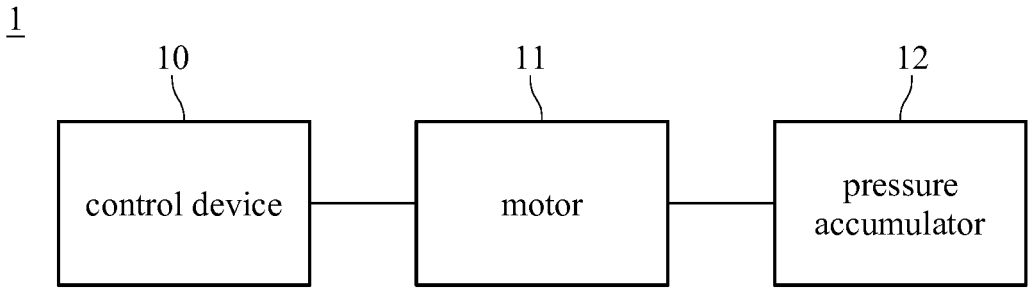
FIG. 1 is a block diagram illustrating an oil pressure control system according to an embodiment of the present disclosure.

Please refer to FIG. 1, wherein FIG. 1 is a block diagram illustrating an oil pressure control system according to an embodiment of the present disclosure. As shown in FIG. 1, the oil pressure control system 1 is adapted for mechanical equipment, such as a machine tool (not shown in the figure), and includes a control device 10, a motor 11 and a pressure accumulator 12, wherein the pressure accumulator 12 is selectively disposed.

The control device 10 is connected to the mechanical equipment and the motor 11, the motor 11 is connected to the pressure accumulator 12. The control device 10 may include one or more processors, wherein the processor is, for example, a central processing unit, a microcontroller, a programmable logic controller or any other processor with signal processing functions. The motor 11 may be a servomotor or a variable-frequency motor. The pressure accumulator 12 may be configured to store pressure and controlled to release pressure. Also, one or more oil paths of the mechanical equipment and the pressure accumulator 12 may each include a pressure sensor connected to the control device 10 so that the control device 10 may monitor the pressure of the oil paths of the mechanical equipment and the pressure of the pressure accumulator 12.

The control device 10 is configured to read a processing program from the mechanical equipment, and schedule an operation timing sequence of the motor 11 in advance according to the processing program to obtain a motor operation timing sequence, and control an operation of the motor 11 according to the motor operation timing sequence. The processing program may include processing codes (for example, processing codes of processing tools and activation code of the motor etc.) recorded in the form of M code. The processing program includes an action sequence, frequency and operation of each processing tool (not shown in the figure), wherein the processing tool may include a hydraulic turret and a chuck of the processing machine.

Figure 2:
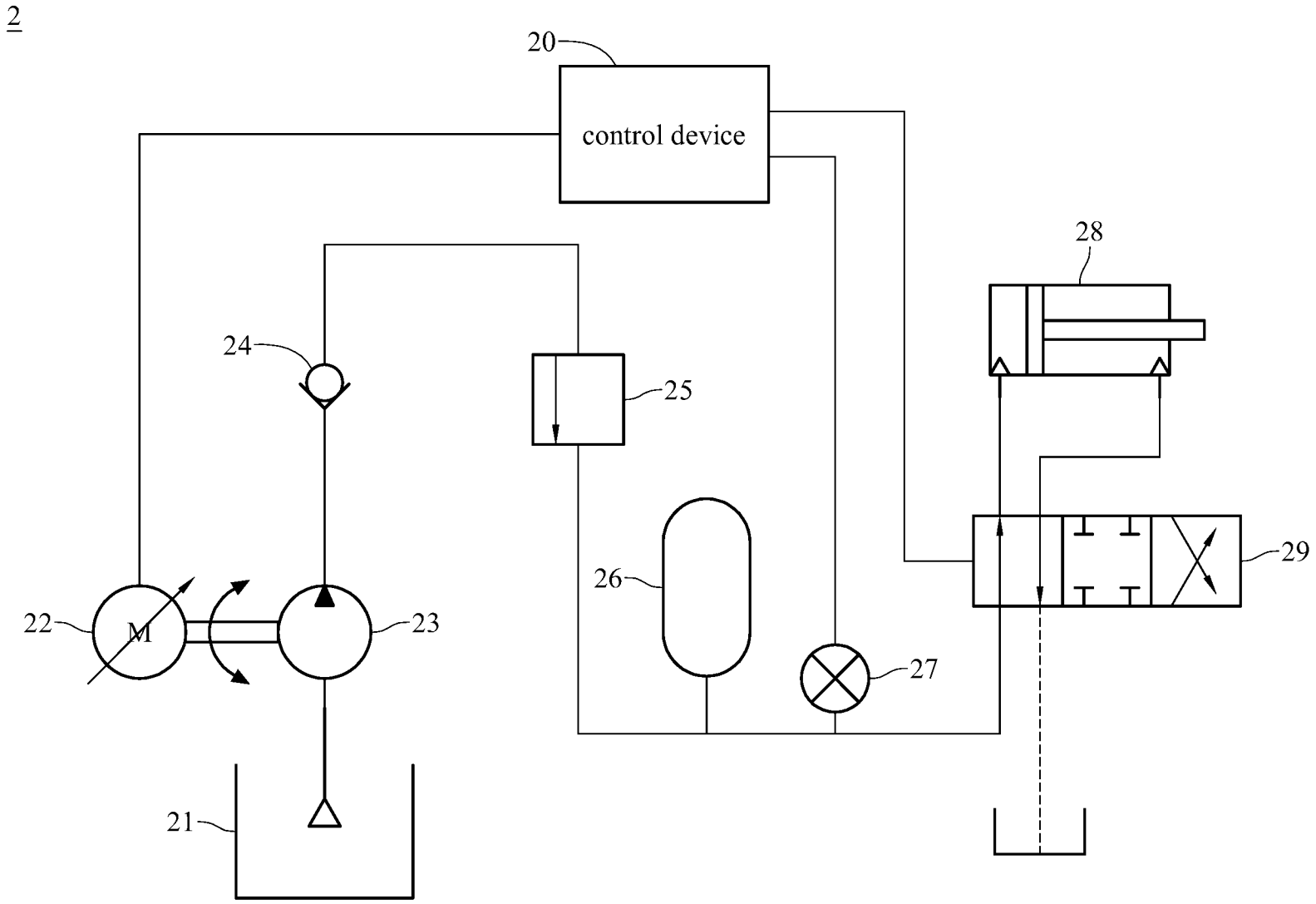
FIG. 2 is a structural diagram illustrating an oil pressure control system according to another embodiment of the present disclosure.

Please refer to FIG. 2, wherein FIG. 2 is a structural diagram illustrating an oil pressure control system according to another embodiment of the present disclosure. As shown in FIG. 2, the oil pressure control system 2 includes a control device 20, an oil tank 21, a motor 22, a pump 23, a non-return valve 24, an overflow valve 25, a pressure accumulator 26, a pressure sensor 27, a load 28 and a solenoid valve 29. The control device 20 is connected to the motor 22, the pressure accumulator 26, the pressure sensor 27 and the solenoid valve 29. The control device 20, the motor 22 and the pressure accumulator 26 may be the same as the control device 10, the motor 11 and the pressure accumulator 12 shown in FIG. 1, respectively, their descriptions are omitted herein.

The oil tank 21 is configured to store hydraulic oil. The motor 22 is configured to drive the pump 23 to deliver the hydraulic oil in the oil tank 21. The non-return valve 24 is configured to prevent the hydraulic oil from flowing back to the pump 23. The overflow valve 25 is configured to drain the excessive hydraulic oil back to the oil tank 21 when the output pressure of the motor 22 is higher than a set pressure. The pressure sensor 27 may be configured to sense pressure output to the load 28, wherein the load 28 may be any machinery or hydraulic device that requires hydraulic pressure to perform work, such as a hydraulic cylinder. The control device 20 may control the motor 22 according to the pressure sensor 27. The control device 20 may also control the opening or closing of the solenoid valve 29 to control the hydraulic oil to flow from the load 28 back to the oil tank 21 when the solenoid valve 29 is opened.

Figure 3:
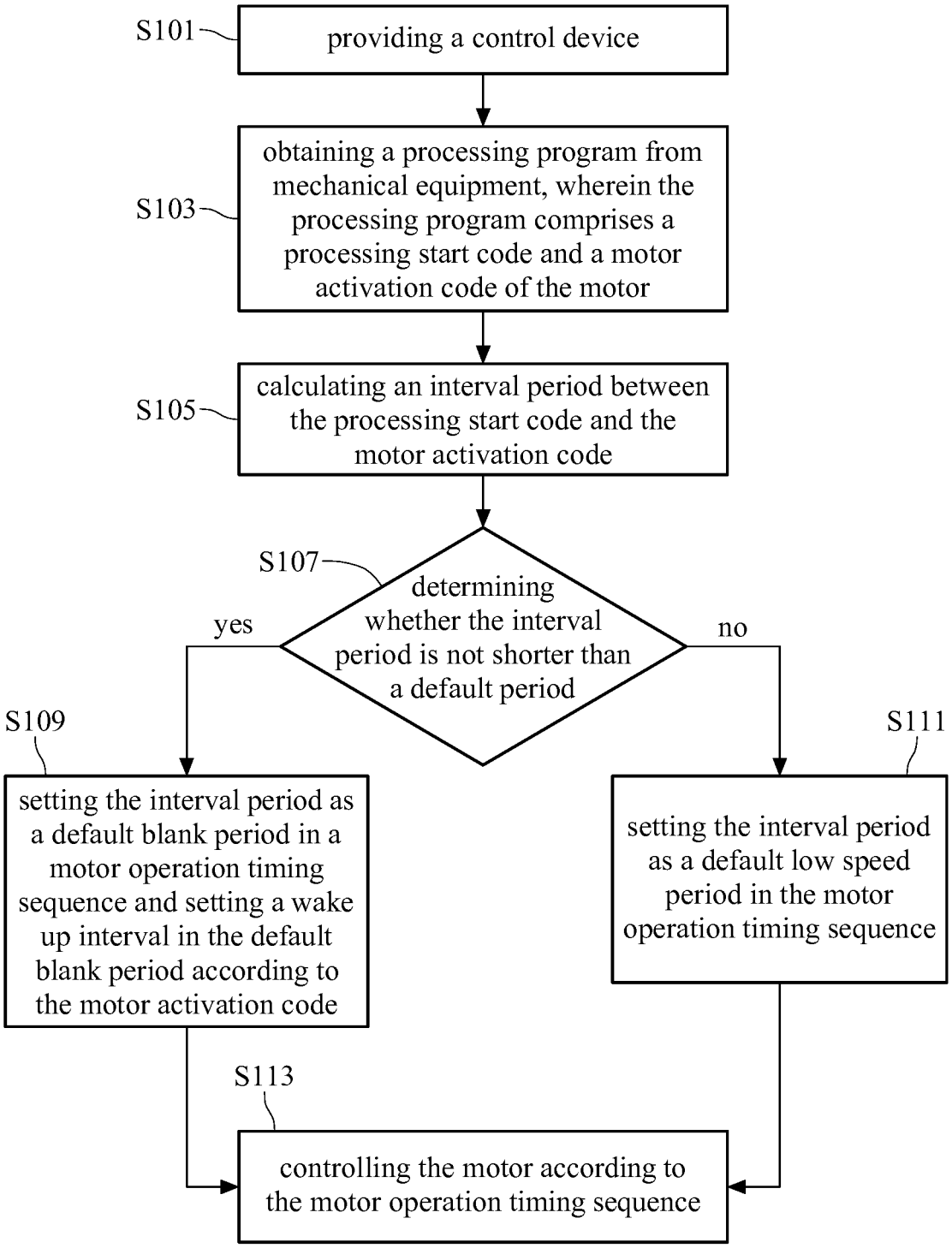
FIG. 3 is a flowchart illustrating an oil pressure control method according to an embodiment of the present disclosure.
Figure 4:
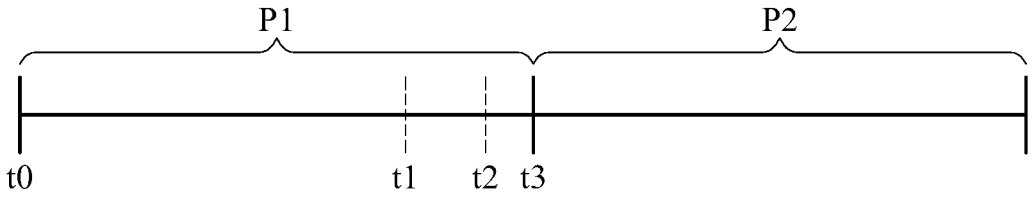
FIG. 4 is a schematic diagram corresponding to FIG. 3.

Please refer to FIG. 1, FIG. 3 and FIG. 4, wherein FIG. 3 is a flowchart illustrating an oil pressure control method according to an embodiment of the present disclosure, and FIG. 4 is a schematic diagram corresponding to FIG. 3. As shown in FIG. 3, the oil pressure control method includes: step S101: providing a control device; step S103: obtaining a processing program from mechanical equipment, wherein the processing program comprises a processing start code and a motor activation code of a motor; step S105: calculating an interval period between the processing start code and the motor activation code; step S107: determining whether the interval period is not shorter than a default period; when the determination result of step S107 is "yes", performing step S109: setting the interval period as a default blank period in a motor operation timing sequence and setting a wake up interval in the default blank period according to the motor activation code; when the determination result of step S107 is "no", performing step S111: setting the interval period as a default low speed period in the motor operation timing sequence; and step S113: controlling the motor according to the motor operation timing sequence. The following uses the control device 10, the motor 11 and the pressure accumulator 12 shown in FIG. 1 as an example to explain the above steps.

In step S101, the control device 10 is provided, and the control device 10 may be initialized. The initialization may be, for example, building a connection relationship between the control device 10 and the motor 11.

In step S103, the control device 10 obtains the processing program from the mechanical equipment. The processing program includes the processing start code and the motor activation code of the motor 11. The processing start code may be a first processing code in the processing program, meaning the first operation performed during the entire processing. The motor activation code may be a processing code indicating when the motor 11 should start operating after the processing starts.

In step S105, the control device 10 calculates the interval period between the processing start code and the motor activation code. In other words, the interval period may be a duration from a time point when the processing starts to a time point when the motor 11 starts operating.

In step S107, the control device 10 determines whether the interval period is not shorter than the default period, wherein the default period is, for example, 15 minutes, but the present disclosure is not limited thereto. When the interval period is not shorter than the default period, it means that the motor 11 corresponds to a long interval operation (i.e. the motor 11 accelerates and decelerates less frequently), and when the interval period is shorter than the default period, it means that the motor 11 corresponds to a short interval operation (i.e. the motor 11 accelerates and decelerates more frequently).

When the interval period is not shorter than the default period, in step S109, the control device 10 sets the interval period as the default blank period in the motor operation timing sequence, and sets the wake up interval in the default blank period according to a time point where the motor 11 starts operating indicated by the motor activation code, wherein an ending time point of the wake up interval is the same as an ending time point of the default blank period. On the contrary, when the interval period is shorter than the default period, in step S111, the control device 10 sets the interval period as the default low speed period in the motor operation timing sequence.

Further, an interval except for the wake up interval in the default blank period indicates the motor having a first rotational speed, and the default low speed period indicates the motor having a second rotational speed, wherein the first rotational speed is lower than the second rotational speed. For example, the first rotational speed is zero, and the second rotational speed is a default minimum rotational speed. In the default blank period and the default low speed period, pressure required for processing may be provided by the pressure accumulator 12.

Take FIG. 4 as an example, wherein FIG. 4 exemplarily illustrates one default hibernation period P1 and one default operating period P2 following the default hibernation period P1, but the present disclosure does not limit the number of the default hibernation period P1 and the number of the default operating period P2. Time point to corresponds to the time point where the processing starts, the time point t3 corresponds to the time point where the motor 11 starts operating. The default hibernation period P1 may be regarded as a hibernation interval of the motor 11, such as the default blank period or the default low speed period of the motor 11; the default operating period P2 may be a period of controlling the motor 11 according to a target pressure. In other words, during the default hibernation period P1, the main pressure source of the mechanical equipment may be other pressure supply devices (for example, the pressure accumulator 12). Also, when the default hibernation period P1 is the default blank period, the interval from the time point t0 to the time point t1 indicates that the motor 11 has the first rotational speed, and the interval between the time point t1 and the time point t2 is the wake up interval.

After setting the motor operation timing sequence, in step S113, the control device 10 controls the operation of the motor 11 according to the motor operation timing sequence. For example, step S113 may include controlling a rotational speed of the motor 11 according to the target pressure when determining that a pressure of the pressure accumulator 12 is lower than the default pressure during the default blank period or the default low speed period, wherein the control device 10 may control the rotational speed of the motor 11 by performing a proportional-integral-derivative (PID) control by using the target pressure. Take FIG. 4 as an example, the control device 10 may determine to start controlling the rotational speed of the motor 11 at the time point t2 according to the PID calculation result, such that the rotational speed of the motor 11 increases to a normal rotational speed at the time point t3, wherein the interval from the time point t2 to the time point t3 may be regarded as a low acceleration and deceleration interval of the motor 11.

In other words, when the processing starts, if the motor operation timing sequence indicates the default blank period, then the motor 11 operates in the first rotational speed; and if the motor operation timing sequence indicates the default low speed period, then the motor 11 operates in the second rotational speed. Further, when arriving at the wake up interval, the control device 10 starts to wake up the motor 11, and the control device 10 may control the rotational speed of the motor 11 according to the target pressure during the wake up interval when determining that the pressure of the pressure accumulator 12 is lower than the default pressure. Therefore, the motor 11 may start operating at the starting time point of the default operating period.

Accordingly, by setting the motor operation timing sequence to pre-activate the motor before the motor needs to start operating, instantaneous changes in the power load caused by frequent acceleration and deceleration of the motor may be avoided, thereby reducing energy consumption.

Figure 5:
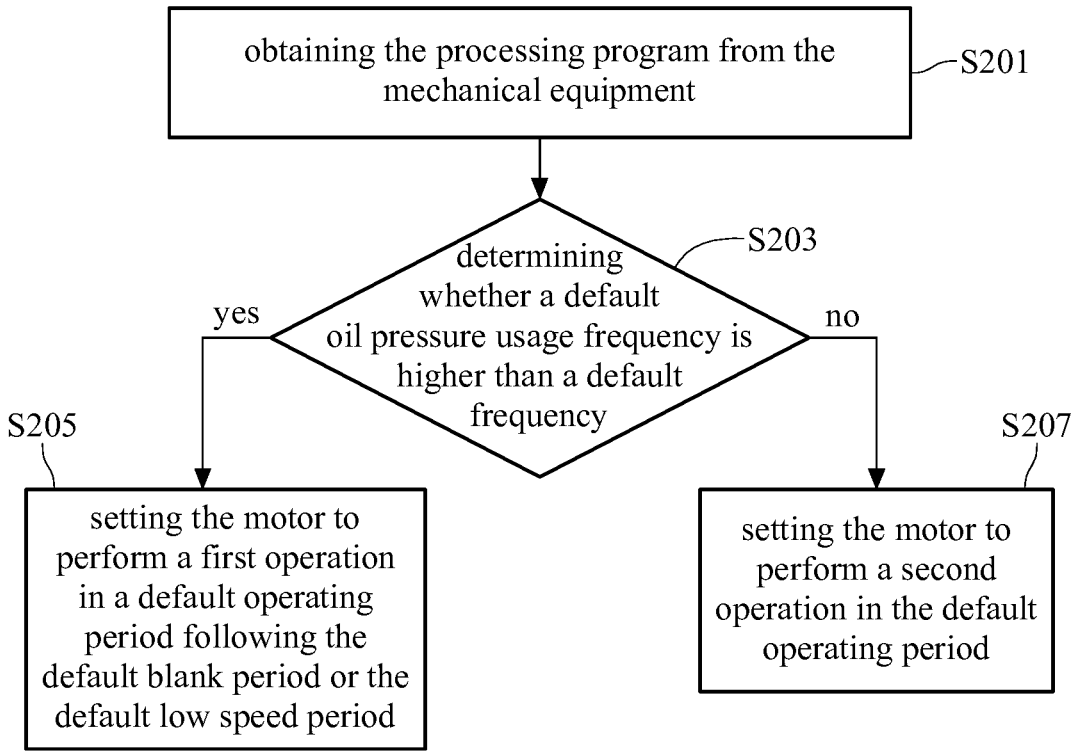
FIG. 5 is a flowchart illustrating setting motor operation according to a default oil pressure usage frequency according to an embodiment of the present disclosure.

Please refer to FIG. 1 and FIG. 5, wherein FIG. 5 is a flowchart illustrating setting motor operation according to a default oil pressure usage frequency according to an embodiment of the present disclosure. Steps S203 and S205 in FIG. 5 may be performed after step S103 of FIG. 3, and the present disclosure does not limit the sequence of performing steps S203 and S205 and steps S105 to S109 in FIG. 3. In the embodiment of FIG. 5, the processing program includes a default oil pressure usage frequency of the mechanical equipment. As shown in FIG. 5, controlling the pressure accumulator and motor operation according to the default oil pressure usage frequency includes: step S201: obtaining the processing program from the mechanical equipment; step S203: determining whether a default oil pressure usage frequency is higher than a default frequency; when the determination result of step S203 is "yes", performing step S205: setting the motor to perform a first operation in a default operating period following the default blank period or the default low speed period; and when the determination result of step S203 is "no", performing step S207: setting the motor to perform a second operation in the default operating period. The following uses the control device 10, the motor 11 and the pressure accumulator 12 shown in FIG. 1 as an example to explain the above steps, wherein step S201 may be the same as step S103 of FIG. 3, its details are not repeated herein.

In step S203, the control device 10 determines whether the default oil pressure usage frequency included in the processing program is higher than the default frequency to set the operation of the motor 11 in the default operating period according to the determination result. The default oil pressure usage frequency may include one or more of the frequency of replacement of processing tools, the frequency of clamping and unclamping tools, and the frequency of using braking unit, etc., the present disclosure is not limited thereto.

When the control device 10 determines that the default oil pressure usage frequency is higher than the default frequency, it means that the processing may require frequent processing by the motor 11. Therefore, the control device 10 performs step S205 to set the motor 11 to perform the first operation during the default operating period. The first operation may include activating the motor 11 when the pressure of the pressure accumulator 12 is lower than the default pressure. Said activating the motor 11 may include controlling the motor 11 according to the target pressure. Further, said activating the motor 11 may be using the target pressure as a reference value, and performing PID calculation according to a pressure difference between the target pressure and the pressure of the motor 11 (i.e. load pressure). Further, when the pressure of the pressure accumulator 12 is lower than the default pressure, the first operation may include replenishing the pressure of the pressure accumulator 12 when the pressure of the pressure accumulator 12 is lower than the default pressure.

In addition, in other embodiments, the first operation may include controlling the motor 11 to output working pressure during the default operating period P2 and controlling the pressure accumulator 12 to replenish the insufficient working pressure. In other words, during the first operation, the control device 10 may control the motor 11 to output power and cooperate with the pressure output by the pressure accumulator 12, thereby reducing frequent acceleration and deceleration of the motor 11.

On the contrary, when the control device 10 determines that the default oil pressure usage frequency is not higher than the default frequency, it means that the processing may not require frequent processing by the motor 11. Therefore, the control device 10 may set the motor 11 to perform the second operation during the default operating period P2, wherein the second operation is different from the first operation. For example, the second operation may include controlling the motor 11 to operate in the first rotational speed or the second rotational speed.

By setting the operation of the motor according to the default oil pressure usage frequency, the need for frequent acceleration and deceleration of the motor due to frequent switching between hibernation (sleep) mode and activation mode may be avoided, thereby reducing the energy consumption of the motor.

Figure 6:
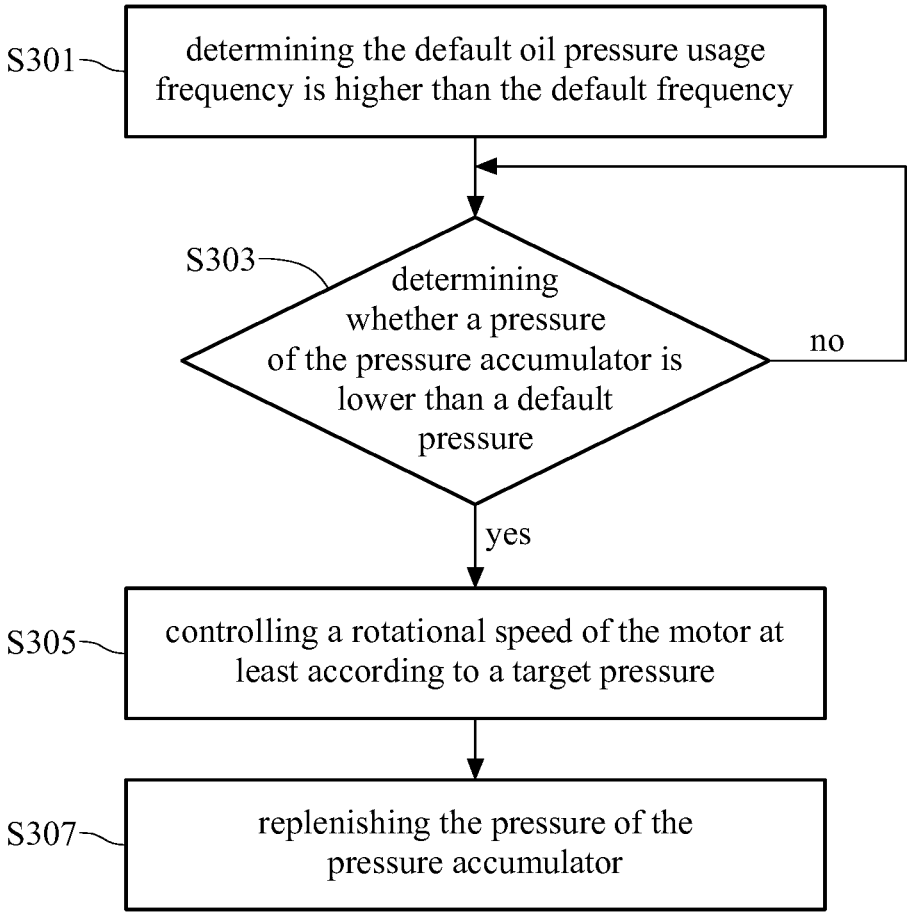
FIG. 6 is a flowchart illustrating controlling motor according to a pressure of a pressure accumulator according to an embodiment of the present disclosure.

Please refer to FIG. 1 and FIG. 6, wherein FIG. 6 is a flowchart illustrating controlling motor according to a pressure of a pressure accumulator according to an embodiment of the present disclosure. Steps S303, S305 and S307 of FIG. 6 may be regarded as a detail flowchart of an embodiment of the first operation. As shown in FIG. 6, the first operation includes: step S301: determining the default oil pressure usage frequency is higher than the default frequency; step S303: determining whether a pressure of the pressure accumulator is lower than a default pressure; when the determination result of step S303 is "yes", performing step S305: controlling a rotational speed of the motor at least according to a target pressure; step S307: replenishing the pressure of the pressure accumulator; and when the determination result of step S303 is "no", performing step S305 again. Step S301 may be regarded as the situation where the determination result of step S203 in FIG. 5 is "yes", and its detail descriptions are not repeated herein. In addition, the sequence of performing step S305 and step S307 is not limited to the sequence shown in FIG. 6, and the method may include only performing one of step S305 and step S307. The following uses the control device 10, the motor 11 and the pressure accumulator 12 shown in FIG. 1 as an example to explain the above steps.

In step S303, the control device 10 may obtain the pressure of the pressure accumulator 12 from the pressure sensor of the pressure accumulator 12 to determine whether the pressure of the pressure accumulator 12 is lower than the default pressure. When the pressure of the pressure accumulator 12 is not lower than the default pressure, the first operation may include performing step S303 again to monitor the pressure accumulation state of the pressure accumulator 12 in real time during actual processing operations.

When the pressure of the pressure accumulator 12 is lower than the default pressure, in step S305, the control device 10 may control the motor 11 according to the target pressure. As described above, the control device 10 may perform PID control on the rotational speed of the motor 11 according to the load pressure and the target pressure. Since the pressure of the pressure accumulator 12 is lower than the default pressure, the pressure accumulator 12 may be in a suspension state. Therefore, in step S307, the motor 11 may replenish the pressure of the pressure accumulator 12.

Figure 7:
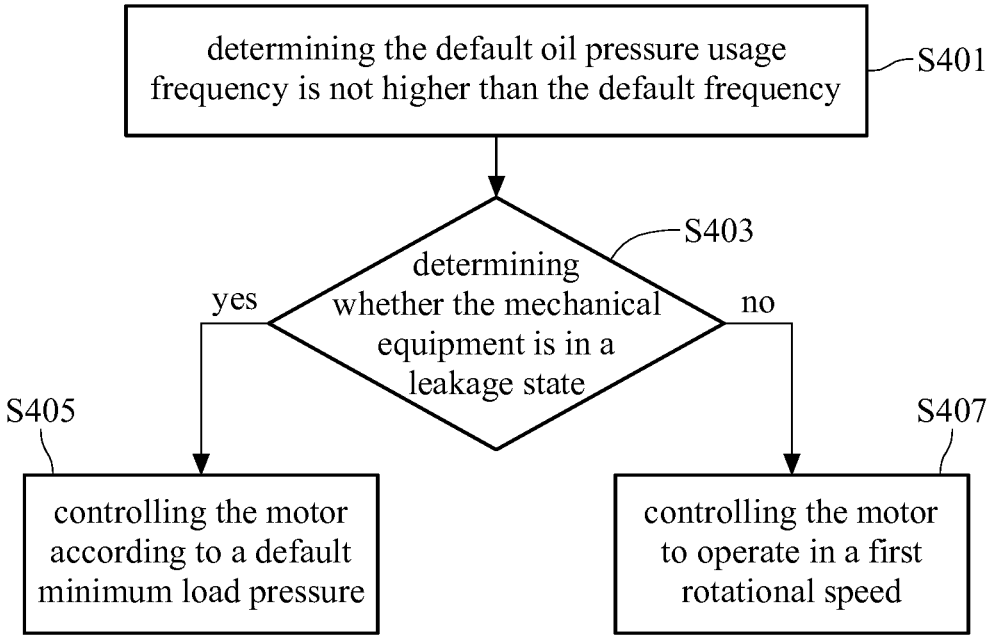
FIG. 7 is a flowchart illustrating controlling pressure output by a motor according to an embodiment of the present disclosure.

Please refer to FIG. 1 and FIG. 7, wherein FIG. 7 is a flowchart illustrating controlling the motor according to an embodiment of the present disclosure. FIG. 7 may be regarded as a detail flow chart of an embodiment of the second operation. As shown in FIG. 7, the second operation includes: step S401: determining the default oil pressure usage frequency is not higher than the default frequency; step S403: determining whether the mechanical equipment is in a leakage state; when the determination result of step S403 is "yes", performing step S405: controlling the motor according to a default minimum load pressure; and when the determination result of step S403 is "no", performing step S407: controlling the motor to operate in a first rotational speed. Step S401 may be regarded as the situation where the determination result of step S203 in FIG. 5 is "no", and its detail descriptions are not repeated herein. The following uses the control device 10, the motor 11 and the pressure accumulator 12 shown in FIG. 1 as an example to explain the above steps.

In step S403, the control device 10 determines whether the mechanical equipment is in the leakage state, wherein the leakage state may indicate that there is oil leakage in the mechanical equipment. Further, when a sensed pressure of a pressure sensor at the oil path of the mechanical equipment is lower than a default value, the control device 10 may determine that there is oil leakage in the mechanical equipment accordingly.

When the control device 10 determines that the mechanical equipment is in the leakage state, the control device 10 performs step S405 to control the pressure of the motor 11 as the default minimum load pressure, so that the motor 11 operates in the default minimum rotational speed. In addition, the control device 10 may perform PID calculation on the pressure difference between the current pressure (i.e. the load pressure) of the motor 11 and the default minimum load pressure to control the motor 11.

On the contrary, when the control device 10 determines that the mechanical equipment is not in the leakage state, the control device 10 performs step S407 to lower the current pressure of the motor 11 to zero, so that the motor 11 may enter the hibernation mode. In other words, the operation of the motor 11 completely stops. Accordingly, the power consumption of the motor may be reduced, thereby avoiding unnecessary waste.

Figure 8:
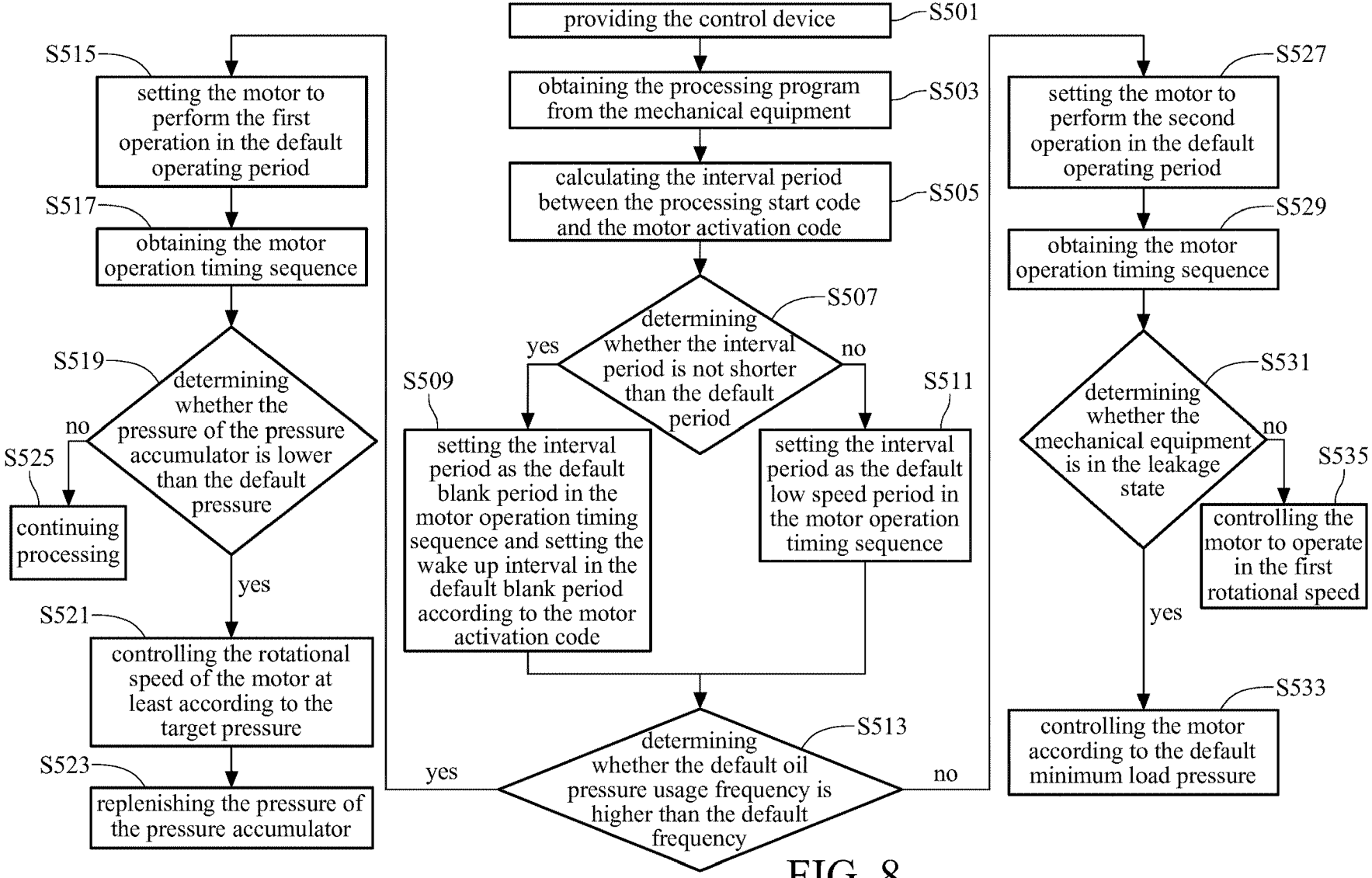
FIG. 8 is a flowchart illustrating an oil pressure control method according to embodiments of the present disclosure.

Please refer to FIG. 1 and FIG. 8, wherein FIG. 8 is a flowchart illustrating an oil pressure control method according to embodiments of the present disclosure. It should be noted that in FIG. 8, step S501 to step S515 and step S527 may be regarded as the stage of scheduling in advance, meaning the stage of generating the motor operation timing sequence; and step S517 to step S525 and step S529 to step S535 may be regarded as the stage of actual processing, meaning processing according to the motor operation timing sequence.

As shown in FIG. 8, the oil pressure control method according to embodiments of the present disclosure includes: step S501: providing the control device; step S503: obtaining the processing program from the mechanical equipment; step S505: calculating the interval period between the processing start code and the motor activation code; step S507: determining whether the interval period is not shorter than the default period; when the determination result of step S507 is "yes", performing step S509: setting the interval period as the default blank period in the motor operation timing sequence and setting the wake up interval in the default blank period according to the motor activation code; when the determination result of step S507 is "no", performing step S511: setting the interval period as the default low speed period in the motor operation timing sequence; step S513: determining whether the default oil pressure usage frequency is higher than the default frequency; when the determination result of step S513 is "yes", performing step S515: setting the motor to perform the first operation in the default operating period; step S517: obtaining the motor operation timing sequence; step S519: determining whether the pressure of the pressure accumulator is lower than the default pressure; when the determination result of step S519 is "yes", performing step S521: controlling the rotational speed of the motor at least according to the target pressure; step S523: replenishing the pressure of the pressure accumulator; and when the determination result of step S519 is "no", performing step S525: continuing processing; when the determination result of step S513 is "no", performing step S527: setting the motor to perform the second operation in the default operating period; step S529: obtaining the motor operation timing sequence; step S531: determining whether the mechanical equipment is in the leakage state; when the determination result of step S531 is "yes", performing step S533: controlling the motor according to the default minimum load pressure; when the determination result of step S531 is "no", performing step S535: controlling the motor to operate in the first rotational speed. The following uses the control device 10, the motor 11 and the pressure accumulator 12 shown in FIG. 1 as an example to explain the above steps.

In the steps shown in FIG. 8, steps S501, S503, S505, S507, S509 and S511 are the same as steps S101, S103, S105, S107, S109 and S111 shown in FIG. 3, respectively;

steps S513, S515 and S525 are the same as steps S203, S205 and S207 shown in FIG. 5, respectively, their detail descriptions are not repeated herein.

During the stage of processing according to the motor operation timing sequence, the contents of steps S519, S521 and S523 are the same as steps S303, S305 and S307 of FIG. 6 in the stage of scheduling in advance, respectively; and during the stage of processing according to the motor operation timing sequence, the contents of steps S531, S533 and S535 are the same as steps S403, S405 and S407 of FIG. 7 in the stage of scheduling in advance, respectively, their detail descriptions are not repeated herein. In other words, the stage of scheduling in advance is used to set the operation of controlling the motor 11 during the processing.

In addition, when the determination result of step S519 is "no", the control device 10 may perform step S525 to continue the processing according to the motor operation timing sequence. In other words, when the determination result of step S519 is "no", the control device 10 may perform step S519 again to monitor the pressure accumulation state of the pressure accumulator 12 in real time.

It should be noted that the above uses the oil pressure control system 1 of FIG. 1 for describing FIG. 3, FIG. 5, FIG. 6, FIG. 7 and FIG. 8, but FIG. 3, FIG. 5, FIG. 6, FIG. 7 and FIG. 8 may be also adapted to the oil pressure control system 2 of FIG. 2.

Figure 9:
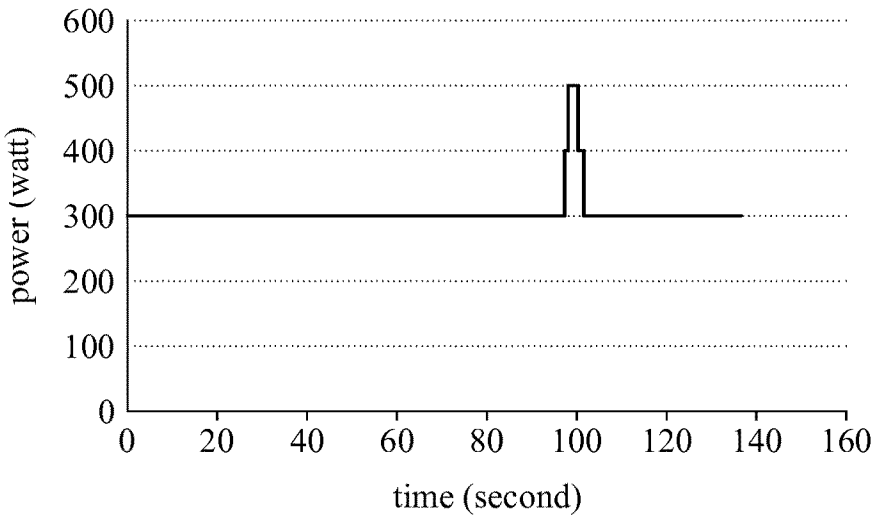
FIG. 9 shows operating power of the motor when the oil pressure control method and system of the present disclosure is not applied.
Figure 10:
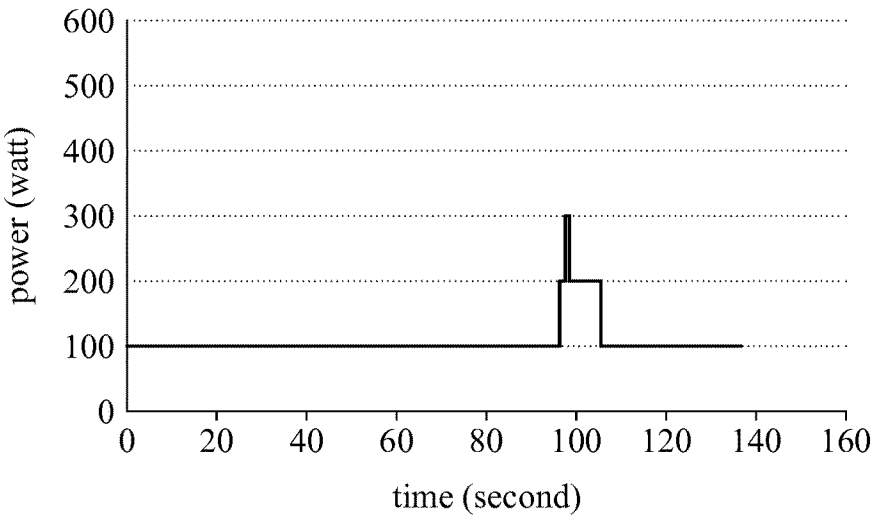
FIG. 10 shows operating power of the motor when the oil pressure control method and system of the present disclosure is applied.

Please refer to FIG. 9 and FIG. 10, wherein FIG. 9 shows operating power of the motor when the oil pressure control method and system of the present disclosure is not applied, and FIG. 10 shows operating power of the motor when the oil pressure control method and system of the present disclosure is applied. Further, FIG. 9 is the operating power of the motor when the processing is directly performed without pre-scheduling, and FIG. 10 is the operating power of the motor when the processing is performed according to the motor operation timing sequence and the motor operation timing sequence is obtained through pre-scheduling.

As shown in FIG. 9, in the standby state, the power consumption of the motor is 300 watts, and when the mechanical equipment (such as the hydraulic turret of the processing machine) starts operating, the power consumption of the motor drastically climbs to 500 watts. After applying the oil pressure control method and system of the present disclosure, as shown in FIG. 10, in the standby state, the power consumption of the motor is 100 watts, and when the hydraulic turret of the processing machine starts operating, the power consumption of the motor slowly climbs to 300 watts because of the pressure supply of the pressure accumulator.

In view of the above, the oil pressure control method and system according to one or more embodiments of the present disclosure, by setting the motor operation timing sequence to pre-activate the motor before the motor needs to start operating, instantaneous changes in the electric load caused by frequent acceleration and deceleration of the motor may be avoided. Further, by controlling the motor and the pressure accumulator to have respective pressure output means for when the default oil pressure usage frequency is higher than the default frequency, the need for frequent acceleration and deceleration of the motor due to frequent switching between hibernation (sleep) mode and activation mode may be avoided, thereby reducing the energy consumption of the motor. In addition, by setting the motor operation timing sequence as controlling the motor according to the default minimum load pressure when the mechanical equipment is not in the leakage state, the power consumption of the motor may be reduced, thereby avoiding unnecessary waste.

What is claimed is:

1. An oil pressure control method, adapted for mechanical equipment, comprising:

providing a control device;

obtaining, by the control device, a processing program from the mechanical equipment, wherein the processing program comprises a processing start code and a motor activation code of a motor;

calculating, by the control device, an interval period between the processing start code and the motor activation code;

determining, by the control device, whether the interval period is not shorter than a default period;

setting, by the control device, the interval period as a default blank period in a motor operation timing sequence and setting, by the control device, a wake up interval in the default blank period according to the motor activation code when determining the interval period is not shorter than the default period;

setting, by the control device, the interval period as a default low speed period in the motor operation timing sequence when determining the interval period is shorter than the default period; and controlling, by the control device, the motor according to the motor operation timing sequence;

wherein an interval except for the wake up interval in the default blank period indicates the motor has a first rotational speed, and the default low speed period indicates the motor has a second rotational speed, wherein the first rotational speed is lower than the second rotational speed.

2. The oil pressure control method according to claim 1, wherein the processing program further comprises a default oil pressure usage frequency, and the method further comprises:

determining whether the default oil pressure usage frequency is higher than a default frequency;

setting the motor to perform a first operation in a default operating period following the default blank period or the default low speed period when determining that the default oil pressure usage frequency is higher than the default frequency; and setting the motor to perform a second operation in the default operating period when determining that the default oil pressure usage frequency is not higher than the default frequency.

3. The oil pressure control method according to claim 2, wherein the first operation comprises controlling a rotational speed of the motor at least according to a target pressure when a pressure of a pressure accumulator is lower than a default pressure.

4. The oil pressure control method according to claim 3, wherein controlling the rotational speed of the motor at least according to the target pressure comprises:

performing a proportional-integral-derivative control on the rotational speed of the motor according to the target pressure and a load pressure.

5. The oil pressure control method according to claim 2, wherein the first operation comprises:

replenishing a pressure of a pressure accumulator when the pressure of the pressure accumulator is lower than a default pressure.

6. The oil pressure control method according to claim 1, wherein the first rotational speed is zero, and the second rotational speed is a default minimum rotational speed.

7. The oil pressure control method according to claim 2, wherein the second operation comprises:

determining whether the mechanical equipment is in a leakage state;

controlling the motor to operate in the first rotational speed when determining that the mechanical equipment is not in the leakage state; and controlling a rotational speed of the motor according to a default minimum load pressure when determining that the mechanical equipment is in the leakage state.

8. The oil pressure control method according to claim 1, wherein controlling the motor according to the motor operation timing sequence comprises:

controlling a rotational speed of the motor according to a target pressure when a pressure of a pressure accumulator is lower than a default pressure in the default blank period or the default low speed period.

9. An oil pressure control system, adapted for mechanical equipment, and comprising:

a motor; and a control device connected to the mechanical equipment, and configured to perform:

obtaining a processing program from the mechanical equipment, wherein the processing program comprises a processing start code and a motor activation code of the motor;

calculating an interval period between the processing start code and the motor activation code;

setting the interval period as a default blank period in a motor operation timing sequence and setting a wake up interval in the default blank period according to the motor activation code when determining the interval period is not shorter than a default period;

setting the interval period as a default low speed period in the motor operation timing sequence when determining the interval period is shorter than the default period; and controlling the motor according to the motor operation timing sequence;

wherein an interval except for the wake up interval in the default blank period indicates the motor having a first rotational speed, and the default low speed period indicates the motor having a second rotational speed, wherein the first rotational speed is lower than the second rotational speed.

10. The oil pressure control system according to claim 9, wherein the processing program further comprises a default oil pressure usage frequency, the control device is further configured to perform determining whether the default oil pressure usage frequency is higher than a default frequency, wherein:

setting the motor to perform a first operation in a default operating period following the default blank period or the default low speed period when determining that the default oil pressure usage frequency is higher than the default frequency; and setting the motor to perform a second operation in the default operating period when determining that the default oil pressure usage frequency is not higher than the default frequency.

11. The oil pressure control system according to claim 10, further comprising a pressure accumulator, wherein the first operation comprises controlling a rotational speed of the motor at least according to a target pressure when a pressure of the pressure accumulator is lower than a default pressure.

12. The oil pressure control system according to claim 11, wherein the control device is configured to perform a proportional-integral-derivative control on the rotational speed of the motor according to the target pressure and a load pressure.

13. The oil pressure control system according to claim 10, further comprising a pressure accumulator, wherein the first operation comprises replenishing a pressure of the pressure accumulator when the pressure of the pressure accumulator is lower than a default pressure.

14. The oil pressure control system according to claim 9, wherein the first rotational speed is zero, and the second rotational speed is a default minimum rotational speed.

15. The oil pressure control system according to claim 10, wherein the second operation comprises determining whether the mechanical equipment is in a leakage state, wherein:

controlling the motor to operate in the first rotational speed when determining that the mechanical equipment is not in the leakage state; and controlling a rotational speed of the motor according to a default minimum load pressure when determining that the mechanical equipment is in the leakage state.

16. The oil pressure control system according to claim 9, wherein the control device is configured to control a rotational speed of the motor according to a target pressure when a pressure of a pressure accumulator is lower than a default pressure in the default blank period or the default low speed period.

* * * * *